United States Patent [19]

Komiya

[11] Patent Number: 5,027,153

[45] Date of Patent: Jun. 25, 1991

[54] IMAGE FORMING APPARATUS WITH CARD DEVICE INPUT

[75] Inventor: Yutaka Komiya, Tokyo, Japan

[73] Assignee: Canon Kabushiki Kaisha, Tokyo, Japan

[21] Appl. No.: 474,301

[22] Filed: Feb. 5, 1990

Related U.S. Application Data

[63] Continuation of Ser. No. 298,334, Jan. 17, 1989, abandoned, which is a continuation of Ser. No. 948,070, Dec. 31, 1986, abandoned.

[30] Foreign Application Priority Data

Jan. 7, 1986 [JP] Japan ..... 61-209

[51] Int. Cl.[5] ..... G03G 15/00

[52] U.S. Cl. ..... 355/200; 355/313

[58] Field of Search ..... 355/200, 204, 313, 314, 355/209; 235/379, 380, 492

[56] References Cited

U.S. PATENT DOCUMENTS 4,248,529 2/1981 Sato et al. ..... 355/14 C X
4,310,235 1/1982 Lorenzo et al. ..... 355/6
4,709,137 11/1987 Yoshida ..... 235/492 X
4,711,560 12/1987 Hosaka et al. ..... 355/200

FOREIGN PATENT DOCUMENTS 0052867 3/1985 Japan ..... 355/6
0263166 12/1985 Japan ..... 355/6

*Primary Examiner*—Joan H. Pendegrass
*Attorney, Agent, or Firm*—Fitzpatrick, Cella, Harper & Scinto

[57] ABSTRACT

An image forming apparatus capable of reserving one or more copy modes independently of a currently performed image forming operation by the insertion of a card device such as an IC card in which are programmed, by means of input switches, at least one operational mode program. The card device is inserted into a card inlet formed in the main body of the apparatus. This card device is also programmed with information on official use management and information on a copy mode to be set. A copying operation is started when this card is inserted into the card inlet to check the use management information and copy mode information and when the programmed operational mode is determined to be useable in the apparatus.

11 Claims, 6 Drawing Sheets

IMAGE FORMING APPARATUS WITH CARD DEVICE INPUT

This application is a continuation of application Ser. No. 298,334 filed Jan. 17, 1989 which was a continuation of application Ser. No. 948,070, filed Dec. 31, 1986, both now abandoned.

BACKGROUND OF THE INVENTION

1. Field of the Invention

This invention relates to an image forming apparatus which is capable of being supplied with data by means of a card.

2. Description of the Prior Art

A type of duplicating machine has been previously proposed which has a plurality of paper trays and which, in order to supply the originals on these trays to the copying process, selects the right tray in accordance with the order in which the originals have been set.

This type of duplicating machine having reserve modes has been designed to perform reserve setting through the medium of input switches and indicators disposed on a control panel. It is not preferable, in terms of control performance, for this apparatus to be operated in such a manner that the next reserve mode is set through an ordinary operational section while a copying job is being executed. Moreover, to do so would increase the risk of error in operation which may affect the job being performed. A special control panel or a group of input and indicating means may be provided to eliminate this risk, but these additional devices increase the overall size and cost of the apparatus.

SUMMARY OF THE INVENTION

The present invention provides a solution to the problems of the above-described conventional arrangement, and an object of the present invention is to provide an improved image forming apparatus.

Another object of the present invention is to provide an image forming apparatus capable of reserving a plurality of image forming modes independently of the operation of the main body by employing a device with a simple construction.

Still another object of the present invention is to provide an image forming apparatus adapted for reserving a plurality of image forming modes without increasing the overall size of the apparatus.

A further object of the present invention is to provide an image forming apparatus capable of allowing image forming modes to be set by means of a card.

A still further object of the present invention is to provide an image forming apparatus capable of being started, when supplied with electric power by the operation of a card.

A still further object of the present invention is to provide an image forming apparatus which controls image forming operations by utilizing a card on which items of use management and copy mode information are recorded.

The present invention provides, in one aspect, an image forming apparatus comprising an image forming means, a card device, a first memory means and a controlling means. The image forming means forms an image on a recording medium. The image forming means is also constructed to have a card device insertable therein. The card device is insertable into the image forming means and is programmed to set an operational mode of the image forming means. The first memory means is in the image forming apparatus and stores the program of the card device when the card device is inserted into the image forming apparatus. The controlling means is also in the image forming apparatus and controls its operational mode. The controlling means is responsive to the completion of an image forming operation by the image forming apparatus to cause the image forming means to perform an operational mode corresponding to the program stored in the first memory means. In another aspect, the controlling means is responsive to the operational mode program stored in the first memory means to control the supply of power to the image forming means in accordance therewith.

These and other objects and features of the present invention will become clear upon reading the following descriptions with reference to the accompanying drawings.

DETAILED DESCRIPTION OF THE PREFERRED EMBODIMENTS

Figure 1:
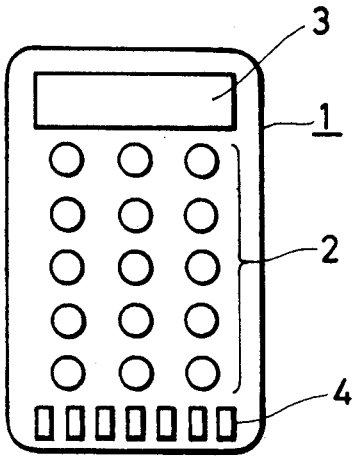
FIG. 1 is an illustration of a card employed in an embodiment of the present invention.

FIGS. 1 to 4 show an embodiment of the present invention involving a card 1 such as an IC (integrated circuit) card, a group of switches 2 provided as input switches on the surface of the card 1, a display portion 3 disposed on the surface of the card 1 together with the group of switches 2, and contact terminals 4 also disposed on the surface of the card 1 through which the card contacts a reader in the control block of a duplicating machine. The internal arrangement of the card 1 is of a standard type with processor portions, namely, CPU (central processing unit) 5, ROM (read only memory) 6, ROM 7 and I/F (input function) 8, as shown in the block diagram of FIG. 3, and which provides the capability to set the operation by employing the group of switches 2 in accordance with copy modes which represent the modes of the image forming processes carried out by the main body 9 of an image forming apparatus such as a duplicating machine. The copy modes are based on, for instance, the duplicating magnification, the number of sheets to be duplicated, the duplicating density, the size of sheets, etc.

Figure 2:
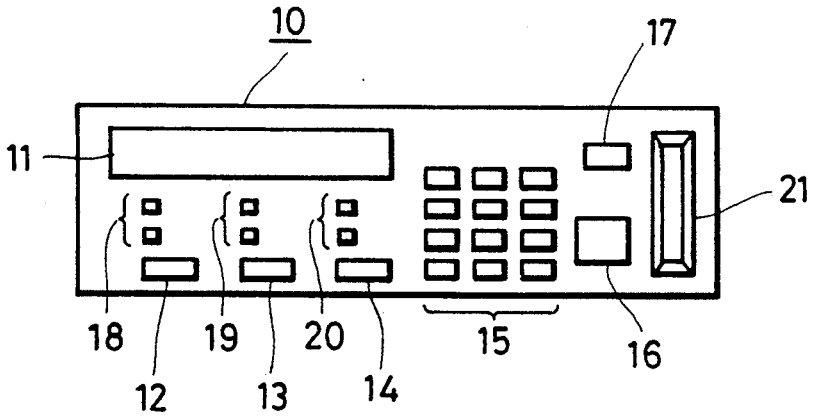
FIG. 2 is an illustration of an example of a control panel of a duplicating machine employed in this embodiment.

FIG. 2 illustrates an example of control and display sections of the image forming apparatus in accordance with the present invention which includes a control panel 10, a display portion 11 disposed on the control panel 10, mode setting keys including a double side mode key 12, a contraction key 13 and a magnification key 14, a key (number) cluster 15 for determining the number of copies, a start key 16, a stop key 17 and display LEDs (light emitting diodes) 18 to 20 which correspond to the mode setting keys 12, 13 and 14.

In an ordinary copying operation of this duplicating machine, an operator or user operates the machine to perform copying by means of the control panel 10, using the display LEDs 18 to 20, the mode setting keys 12 to 14, the key cluster 15, the start key 16 and the stop key 17. A card inlet 21 into which the card 1 is inserted is disposed in the control panel 10 or at some other suitable place on the main body.

Figure 4:
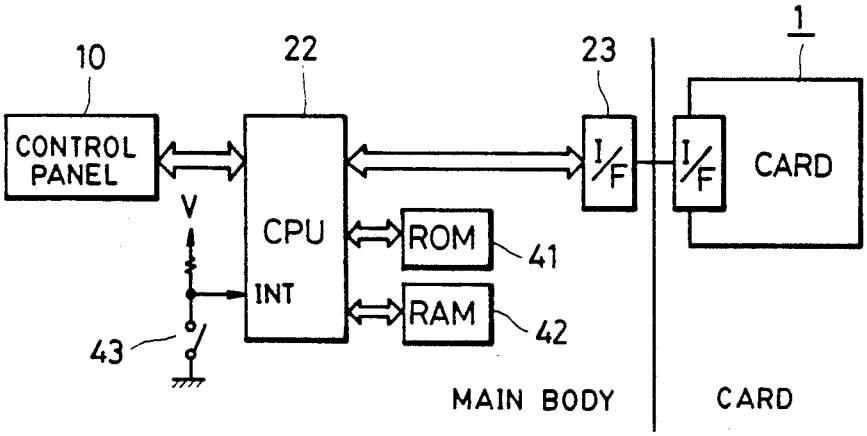
FIG. 4 is a control block diagram of the card of FIG. 1 and the main body of a duplicating machine when connected to each other.

FIG. 4 is a block diagram of the card 1 and the main body 9 when connected to each other. As shown in FIG. 4, the main body 9 incorporates a CPU 22, an I/F 23, a ROM 41 in which are stored programs of the control to be performed by the CPU 22, a RAM 42 for storing various items of data, and a switch 43 adapted for detecting the insertion of the card 1 and connected to the interrupt port of the CPU 22. The display portion 3 of the card 1 may display, as desired, the information necessary for mode setting or the information for identifying which mode has been set by the mode setting means. The card 1 incorporates a battery for the power supply and for memorizing information stored in the card.

The embodiment of the present invention is constituted in the manner described above. In this apparatus, an item of information which has been stored in the card 1 is transmitted to the main body of the duplicating machine when the card 1 is inserted into the card inlet 21. In such case, the card is provided as an input element disposed in the control panel or at some other suitable place on the main body of the duplicating machine.

The card 1 has items of use management information recorded in it relating to each office department to which the duplicating machine has been assigned. The use management information is assumed to include information on each department, the number of copies which each department is allowed to use, and the cumulative number of copies made. The department information and the number of sheets allowed can be put on the card 1 by employing the group of switches 2 before the administrator distributes the cards to the various users, but the card is so designed that the user cannot alter the information recorded on the card. The specific construction of the card to perform these functions is not critical to this invention; and any suitable construction, which can be readily designed by those skilled in the art, can be used.

With respect to an ordinary copying operation, the operator sets the apparatus through the control panel 10 of the main body 9 in a manner similar to that described above with reference to FIG. 2. Once the card 1 is inserted into the card inlet 21 disposed in the control panel 10, the mode which has been set on the card 1 is transmitted as an information item to the main body 9 by way of the I/F 23 and the I/F 8, as shown in FIG. 4, so that it is set as a reserve mode in the main body 9 independently of the copying operation which is currently being carried out. The reserve mode is thus automatically set in the main body 9 by inserting the card 1, on which the image forming mode has been previously set, into the card inlet 21.

Figure 6A:
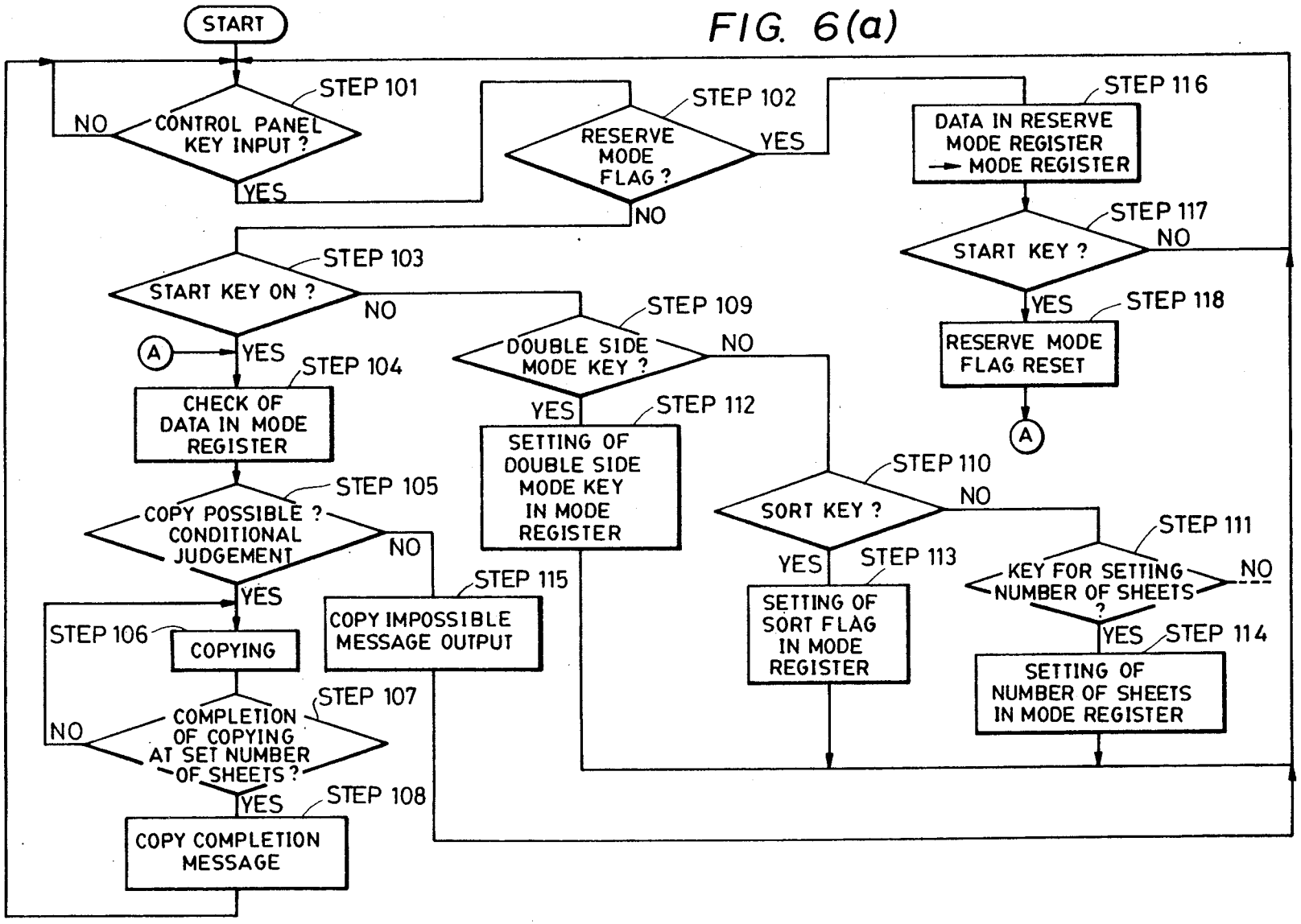
FIGS. 6 (*a*) and 6(*b*) are flowcharts of the operation of the embodiment of FIGS. 1 to 4.
Figure 6B:
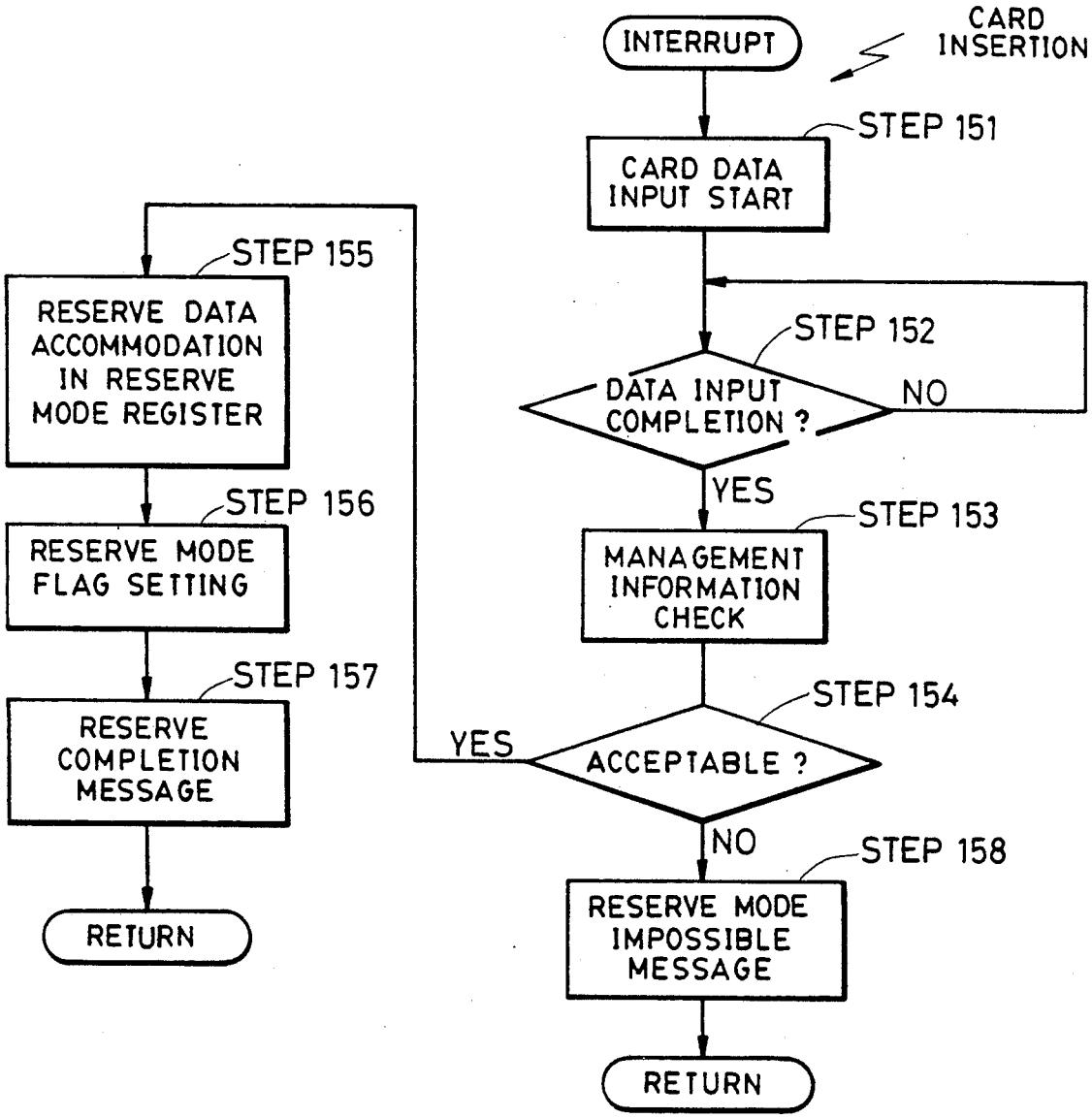

FIGS. 6(*a*) and 6(*b*) illustrate the flows of operational functions of the embodiment of FIG. 4. FIG. 6(*a*) is a main flowchart of the control executed by the CPU 22, and FIG. 6(*b*) is an interrupt flowchart of the process executed in order to read copy mode data from the IC card 1 when the same is inserted. The operation of the apparatus will be described below on the basis of these flowcharts.

At the step 101, a determination is made as to whether or not the key input on the control panel 10 has been effected. If the key input has been effected, a determination is made in step 102 as to whether or not a reserve mode flag, which is described later has been set. If the reserve mode flag has not been set, a determination is made in step 103 as to whether or not the start key 16 has been turned on. If it is not on, in steps 109 to 114 flags are set, in accordance with the sort of key input, in mode registers which have been set within predetermined regions in the RAM 42, and the process returns to the step 101. If the start key 16 is on, the data which is stored in each mode register within the RAM 42 is checked in step 104, and a determination is made in step 105 as to whether or not copying is possible. If copying is possible, the copying operation in this mode is carried out in steps 106 and 107 to make the number of copies which has been designated by means of the key cluster 15. When this operation is completed, a copy end message is indicated on the display portion 11 of the control panel 10.

If, in step 102, it is determined that a reserve mode has been set, the contents of the reserve mode register set in the predetermined region within the RAM 42 are transferred to the above-described mode registers in the step 116. Then a determination is made in step 117 as to whether or not the start key 16 is on. If it is on, the reserve mode flag is reset and the process proceeds to step 104. If the key is not on, the process returns to step 101.

Next, the interrupt process shown in FIG. 6(*b*) will be described. When the IC card 1 is inserted into the card inlet 21 (FIG. 2), the switch 43 (FIG. 4) is turned on and a signal thereby generated is supplied to the interrupt port INT of the CPU 22. The interrupt process is thereby started. The items of card data, namely, the copy mode set in the IC card 1, the use management information imparted to the IC card 1, etc., are read from the RAM 7 at the steps 151 and 152. The use management information includes information on each office department to which the duplicating machine has been assigned, the upper limit of copies which each department is allowed to make, the cumulative number of copies made by each department, etc. Next, the use management information thereby read from the RAM 7 is checked in step 153. If, in step 154, the data is determined to be acceptable, various items of reserve mode data are stored in the mode register of the RAM 42 in step 155. Then, a reserve flag is set in step 156, and a reserve end message is indicated on the display portion 11. If, in step 154, the data is determined to be unacceptable, a message showing that it is not possible to set the reserve mode is indicated on the display portion 11 in step 158. It is possible to set a plurality of items of the copy mode reserve by providing a plurality of reserve mode registers in the RAM 42. The effect of these arrangements is to make it possible to reserve the next copy mode without affecting the copy operation which is currently being executed. The copy mode thereby reserved is read out when the execution of the present copying operation is completed. At that time, the copy operation in this mode becomes available.

It is also possible to provide a reserve copying operation by providing a plurality of trays for accommodating originals and employing an ADF (automatic document feed).

Figure 5:
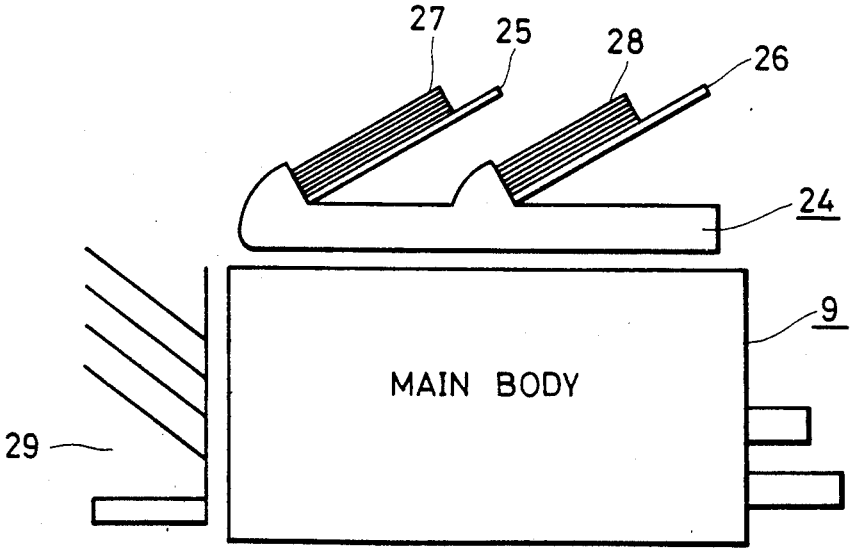
FIG. 5 is an illustration of a duplicating machine and a Reserve ADF (automatic document feed)

FIG. 5 illustrates a Reserve ADF 24 involving a first paper tray 25, second paper tray 26, originals 27 placed on the first paper tray 25, originals 28 placed on the second paper tray 26, and a sorter 29.

When the originals 27 on the first paper tray 25 are supplied to the copying process which is being executed, the originals 28 on the second paper tray 26 are reserved for a reserve copying operation which is to be next executed. The description for the Reserve ADF is omitted, but, in short, it enables reserved copying operations to be alternately performed by employing the pair of paper trays 25 and 26.

Figure 7:
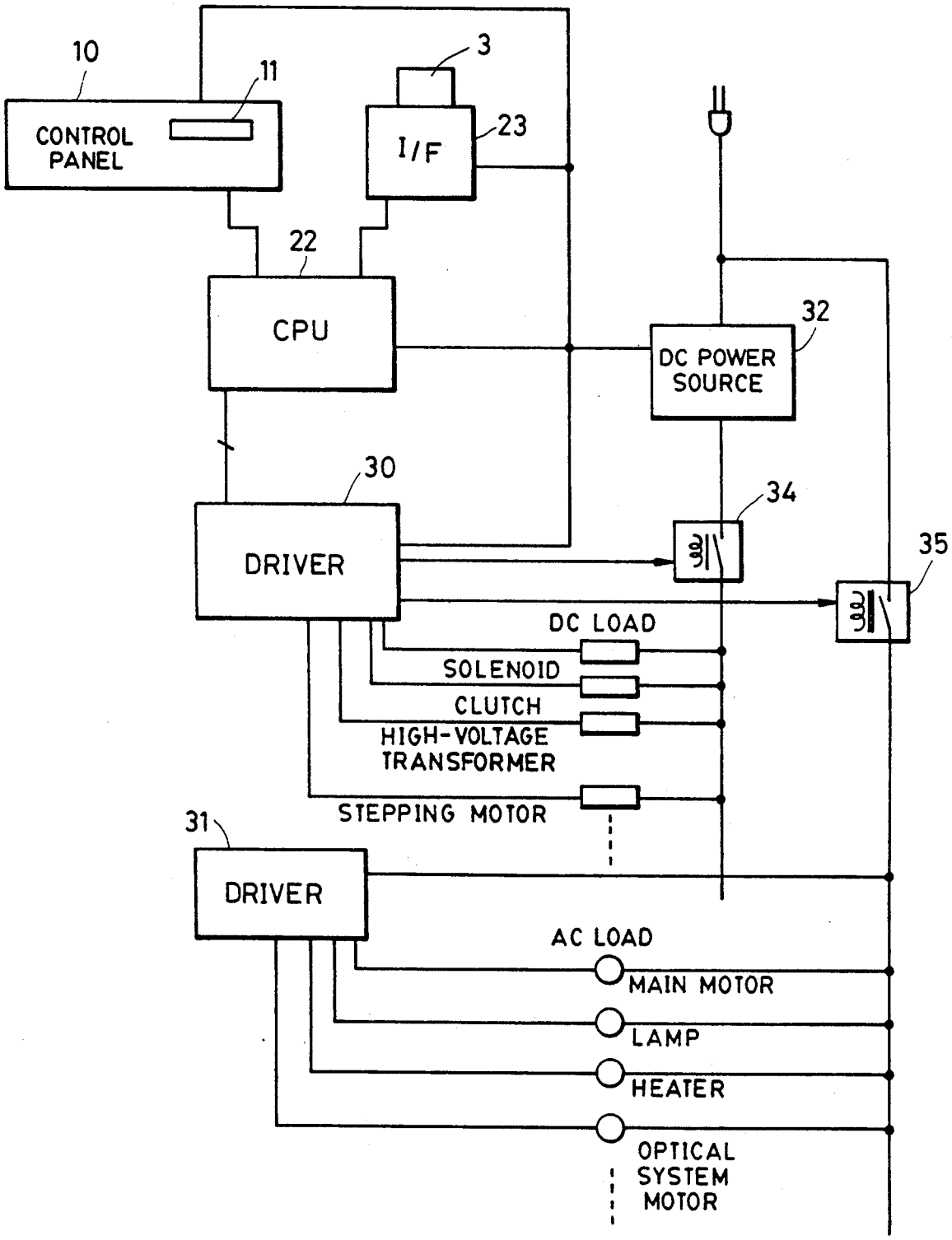
FIG. 7 is a control block diagram of another embodiment of the present invention.
Figure 8:
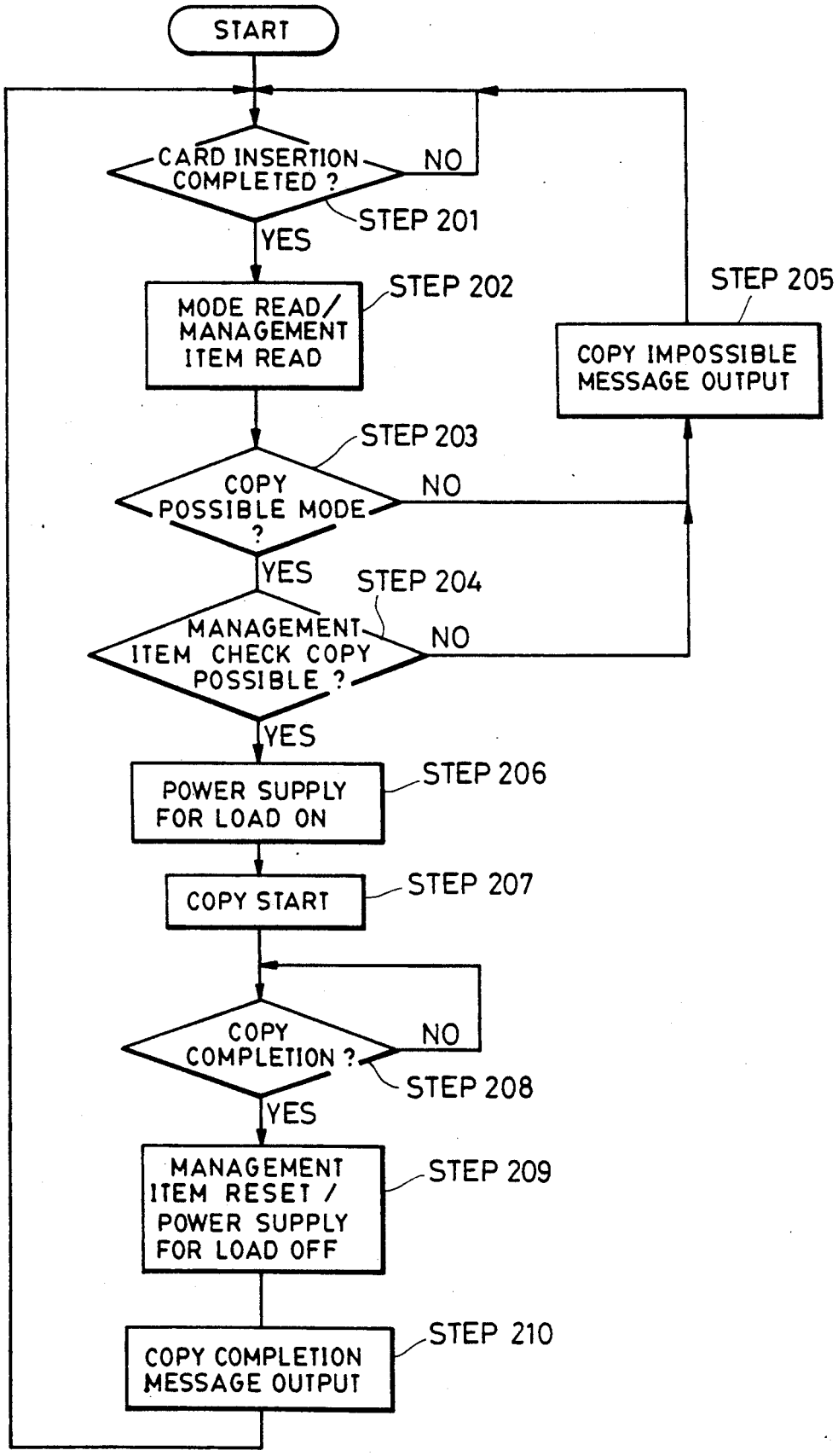
FIG. 8 is a flowchart of the operation of the embodiment of FIG. 7.

FIG. 7 is a control block diagram of another embodiment of the present invention, and FIG. 8 is a flowchart of the operation thereof. In this example, the use management information which has been stored in a card is checked when the card is inserted into the apparatus, and the power supply is turned on. If the checked information is found to be normal, the copying operation is performed. This will be described below in detail with reference to FIGS. 7 and 8.

Figure 3:
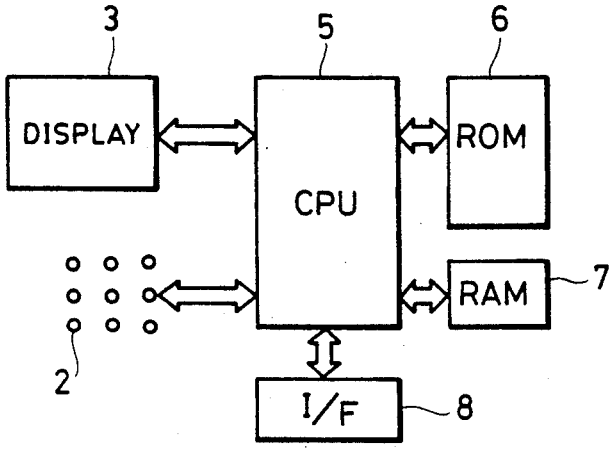
FIG. 3 is a control block diagram of the card of FIG. 1.

In FIG. 7, components having the same reference numerals as those of the components shown in FIGS. 1 to 3 are equivalent to the latter. Other components, which are standard on duplicating machines are: a driver 30 for driving DC loads such as a solenoid, a clutch, a high-voltage transformer, and a stepping motor; a driver 31 for driving AC loads such as a main monitor, an exposure lamp, a fixing heater, and an optical system motor; a DC power source 32 for supplying electric power to the DC loads; and relays 34 and 35 which are turned on and off by the output signals supplied from the driver 30.

FIG. 8 is a flowchart of the operation controlled by the CPU 22. A determination is made in step 201 as to whether or not the IC card 1 has been inserted. If it has been inserted, the copy mode set in the IC card 1 and the use management information imparted to the IC card 1 are read in step 202. The use management information includes information on each office department, the upper limit of copies which each department is allowed to use, the cumulative number of copies made by each department, etc. In the step 203, a determination is made whether or not the copy mode thereby read is a possible mode for conducting the operation. If it is possible to conduct the operation, the process proceeds to step 204. If it is not possible to conduct the operation, the process proceeds to step 205, and a message showing that the copy operation is not permissible is indicated on the display portion 11 of the control panel 10. The use management items are checked in step 204. That is, a determination is made as to whether or not the department is allowed to carry out the copying task from the use management information imparted to the IC card 1, and whether or not the copying operation is possible in terms of the upper limit of the allowed number of copies and the cumulative number of copies made. If the copying operation is determined to be permissible, the process proceeds to step 206, and the relays 34 and 35 are supplied with control signals by way of the driver 30 so that they are turned on. The AC and DC loads are thereby supplied with electric power. In steps 207 and 208, the copy operation is executed in accordance with the copy mode which has been set. When the operation in completed, the use management items including the cumulative number of copies, etc., are reset in step 209, and a copy end message is supplied to the display portion 11 of the control panel 10 in step 210.

The specific construction of the control panel 10, the CPU 22, the ROM 41 and the RAM 42 to perform the above described functions is not critical to this invention; and any suitable construction, which can be readily designed by those skilled in the art, can be used.

The embodiments of the present invention have been described by way of example with respect to an apparatus employing IC cards, but the present invention is not limited to arrangements which require this type of card and any other card may be applicable as long as data can be written on it.

The present invention has been described with respect to a duplicating machine, but it is also applicable to facsimile printers or the like.

What is claimed is:

1. An image forming system, comprising:

a card device for reserving and setting an image forming mode, said card device including a first key input means having a plurality of keys disposed on a surface of said card device and being accessible to a user for manually inputting data corresponding to a desired image forming mode, and memory means for storing said data input by said first key input means; and an image forming apparatus, including:

image forming means for forming an image on a recording medium;

second key input means having a plurality of keys for manually inputting data corresponding to a desired image forming mode;

setting means for demountably receiving said card device therein;

enabling means operative in response to the setting of said card device in said setting means to enable said data stored in said memory means of said card device to be read; and control means for setting the image forming mode either in accordance with said data read from said memory means or data provided by said second key input means.

2. An image forming system according to claim 1, wherein said card device further includes display means for displaying the image forming mode input by said first key input means.

3. An image forming system according to claim 2, wherein said card device is an IC card.

4. An image forming system according to claim 1, wherein said control means includes another memory means for storing the read data, and wherein when said card device is set in said setting means during an image forming operation, said read data is stored in said another storage means, and wherein said control means is arranged to set the image forming mode in accordance with the data stored in said another memory means, after the completion of said image forming operation.

5. An image forming system according to claim 4, wherein said card device is an IC card.

6. An image forming system according to claim 4, wherein said another memory means is capable of storing a plurality of data corresponding to the image forming mode for a plurality of jobs and wherein said control means is constructed to set the image forming mode according to each of said plurality of data in sequence.

7. An image forming system according to claim 4, wherein said image forming means comprises a plurality of storing means for storing originals, supplying means for supplying said original one at a time to an exposure position, and means for forming an image of one of said originals on said recording medium by scanning said original supplied to said exposure position so as to expose said original.

8. An image forming system according to claim 7, wherein said supplying means is arranged to supply said originals from different ones of said plurality of said storing means in accordance with different jobs.

9. An image forming system according to claim 1, wherein said card device is an IC card.

10. An image forming system according to claim 1, further comprising means in said card device for storing use management information.

11. An image forming system according to claim 10, wherein said control means is arranged to determine whether the image forming operation is to be conducted in accordance with said use management information.

* * * * *